US009561813B2

(12) United States Patent
Ohmstede

(10) Patent No.: US 9,561,813 B2
(45) Date of Patent: Feb. 7, 2017

(54) METHOD FOR LOCATING A RAIL VEHICLE

(71) Applicant: SIEMENS AKTIENGESELLSCHAFT, Munich (DE)

(72) Inventor: Hartwig Ohmstede, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 28 days.

(21) Appl. No.: 14/431,391

(22) PCT Filed: Sep. 9, 2013

(86) PCT No.: PCT/EP2013/068609
§ 371 (c)(1),
(2) Date: Mar. 26, 2015

(87) PCT Pub. No.: WO2014/048710
PCT Pub. Date: Apr. 3, 2014

(65) Prior Publication Data

US 2015/0251675 A1 Sep. 10, 2015

(30) Foreign Application Priority Data

Sep. 27, 2012 (DE) ..... 10 2012 217 595

(51) Int. Cl.
*G05D 1/00* (2006.01)
*G05D 3/00* (2006.01)
(Continued)

(52) U.S. Cl.
CPC ..... *B61L 25/025* (2013.01); *B61L 1/163* (2013.01); *B61L 1/18* (2013.01); *B61L 3/121* (2013.01);
(Continued)

(58) Field of Classification Search
CPC ..... B61L 3/121; B61L 15/0027; B61L 1/18; B61L 25/025; B61L 1/163
(Continued)

(56) References Cited

U.S. PATENT DOCUMENTS

| | | | | |
|---|---|---|---|---|
| 7,269,487 | B2 | 9/2007 | Watanabe et al. | |
| 2003/0058119 | A1* | 3/2003 | McAllister | B61L 1/18 340/686.1 |
| 2005/0137760 | A1 | 6/2005 | Watanabe et al. | |

FOREIGN PATENT DOCUMENTS

| | | | |
|---|---|---|---|
| CN | 1629025 | A | 6/2005 |
| CN | 101377524 | A | 3/2009 |

(Continued)

OTHER PUBLICATIONS

W. Fenner et al., "Bahnsicherungstechnik—Steuern, Sichern und Überwachen von Fahrwegen und Fahrgeschwindigkeiten im Schienenverkehr", ["Railway Safety Technology"], 2003, p. 83.

*Primary Examiner* — Maceeh Anwari
(74) *Attorney, Agent, or Firm* — Laurence Greenberg; Werner Stemer; Ralph Locher

(57) ABSTRACT

A method for locating a rail vehicle with a rail vehicle position determination device on a route includes reading positions of reference marks, passed by the rail vehicle, along the route of the rail vehicle and evaluating additional distance information. In order to locate a rail vehicle with little expenditure and with comparatively high accuracy, in the case of a route with at least one track section bounded by axle counting sensor units and having an axle counting evaluator, information on the number of axles from the axle counting evaluator is transferred to the rail vehicle position determination device for determining the position of a rail vehicle. In the rail vehicle position determination device, the position of an axle of the rail vehicle corresponding to the information on the number of axles is determined using
(Continued)

route topology data present there, and this position is used as a further reference mark.

7 Claims, 1 Drawing Sheet

(51) Int. Cl.

| | |
|---|---|
| ***G06F 7/00*** | (2006.01) |
| ***G06F 17/00*** | (2006.01) |
| ***B61L 25/02*** | (2006.01) |
| ***B61L 1/16*** | (2006.01) |
| ***B61L 3/12*** | (2006.01) |
| ***B61L 15/00*** | (2006.01) |
| ***B61L 1/18*** | (2006.01) |
| *B61L 27/00* | (2006.01) |

(52) U.S. Cl.
CPC ..... *B61L 15/0027* (2013.01); *B61L 2027/005* (2013.01)

(58) Field of Classification Search
USPC ..... 701/19
See application file for complete search history.

(56) References Cited

FOREIGN PATENT DOCUMENTS

| | | | |
|---|---|---|---|
| DE | 102007038819 | A1 | 2/2009 |
| DE | 102008026572 | A1 | 12/2009 |
| DE | 102009042359 | A1 | 3/2011 |

* cited by examiner

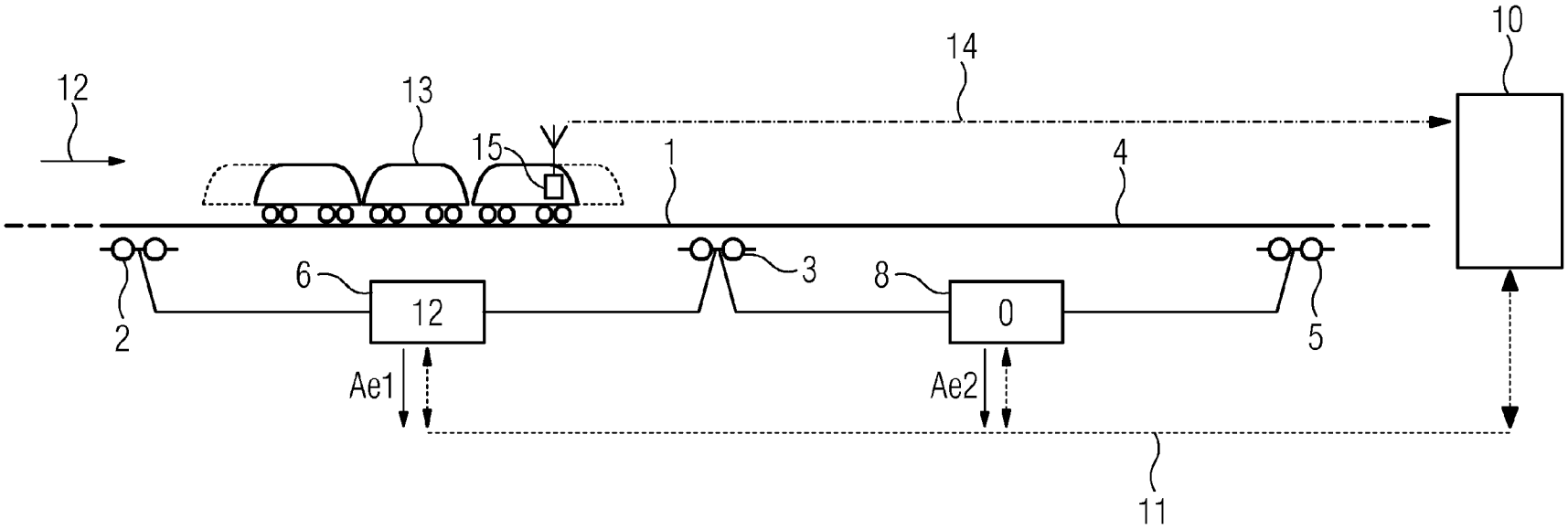
10
14
12
13
15
1
4
3
5
2
6
12
8
0
Ae1
Ae2
11

METHOD FOR LOCATING A RAIL VEHICLE

BACKGROUND OF THE INVENTION

Field of the Invention

The invention relates to a method for locating a rail vehicle with a rail vehicle position determination device on a route by means of reading the positions of reference marks along the route passed by the rail vehicle and by evaluating additional distance data.

In a known method of this type (W. Fenner, P. Neumann, J. Trinckauf "Bahnsicherungstechnik" ["Railway Safety Technology"], 2003, Page 83) balises are used as reference marks, as well as odometers on-board the rail vehicles with which additional distance data can be acquired. The balises serve here to calibrate the odometer.

Brief Summary of the Invention

The object underlying the invention is to further develop the known method, so that with little effort a rail vehicle can be located with a comparatively high level of accuracy.

With a method as specified above according to the invention, to achieve this object in the case of a route with at least one track section with an axle counter evaluator that is bordered by axle counter sensor units, information on the number of axles is transferred from the axle counter evaluator to the rail vehicle position determination device; in the rail vehicle position determination device, using existing track topology data the position of an axle of the rail vehicle that corresponds to the information on the number of axles is determined and this position is used as a further reference mark.

A major advantage of the method according to the invention is that the existing axle counter evaluators on the track sections with axle counter sensor units are assigned an additional function, in that they are used in conjunction with the rail vehicle position determination devices to form further reference marks in addition to the usual reference marks formed by the balises. Location uncertainty can then be reduced in particular where the distance between the reference marks/balises is relatively large and track sections with axle counter sensor units exist anyway and according to the invention are used to form further reference marks.

In the method according to the invention, the information on the number of axles can be transferred in different ways to the rail vehicle position determination device. It is advantageous if the information on the number of axles is transferred from the axle counter evaluator directly to the rail vehicle position determination device, as in this case the transmission route is short and the transmission time is also therefore short. The determination of the position of the axle of the rail vehicle that corresponds to the information on the number of axles can therefore take place easily and very precisely. If in this case the transfer takes place advantageously via a radio link, then any additional effort is comparatively low, as an ordinarily already existing reception device of the rail vehicle position determination device can also be used for this.

In this respect an embodiment of the method according to the invention is more advantageous in which the information on the number of axles is transferred from the axle counter evaluator via a train protection unit to the rail vehicle position determination device. Here it is advantageous if the information on the number of axles is transferred from the axle counter evaluator via a communications link to the train protection unit and from this via a message link to the rail vehicle position determination device. Here, existing information transfer methods can be utilized, for example CBTC solutions for metro systems.

In this embodiment of the method according to the invention, in order to avoid inaccuracies in determining the position of the axle of the rail vehicle that corresponds to the information on the number of axles, a time synchronization is performed advantageously between the axle counter evaluator and the rail vehicle position determination device, which can take place for example by means of time stamps.

In order to be able to determine the position of the axle that corresponds to the information on the number of axles and thereby the location of the rail vehicle particularly reliably and also precisely, it is deemed advantageous in the case of a further axle counter evaluator assigned to a subsequent track section to transfer further information on the number of axles from this further axle counter evaluator to the rail vehicle position determination device and to use the further information on the number of axles as redundant information on the number of axles in determining the position of the axle in the rail vehicle position determination device.

BRIEF DESCRIPTION OF THE SINGLE VIEW OF THE DRAWING

In order to further explain the invention, an exemplary embodiment of a suitable arrangement for carrying out the method according invention is shown in the FIGURE.

DESCRIPTION OF THE INVENTION

In the FIGURE a track section 1 is shown, which is bordered by an axle counter sensor unit 2 and a further axle counter sensor unit 3; in the exemplary embodiment shown, the track section 1 is connected to a further track section 4, which is on the one side determined by a further axle counter sensor unit 3 and on the other side by an additional axle counter sensor unit 5. The axle counter sensor units 2 and 3 are connected with an axle counter evaluator 6. The further axle counter sensor unit 3 is, together with the additional axle counter sensor unit 5, connected to a further axle counter evaluator 8.

In the exemplary embodiment shown a train protection unit 10 is assigned to the track sections 1 and 4, which is therefore provided on the track side. The train protection unit 10 is connected via a bidirectional communications link 11 to both the one axle counter evaluator 6 as well as to the further axle counter evaluator 8. Information on the number of axles Ae1 is transferred from the one axle counter evaluator 6 to the automatic train protection unit 10, when a rail vehicle 13 moves in the direction of an arrow 12 into the one track section 1. If a rail vehicle is located completely in the one track section 1, then this information on the number of axles Ae1 will reflect the number of axles as captured by the one axle sensor unit 2. Accordingly the same applies to the further axle counter evaluator 8, which sends further information on the number of axles Ae2 to the automatic train protection unit 10, when a rail vehicle has entered into this track section. In the example shown according to the FIGURE a number of axles "12" in the first track section 1 and a number of axles "0" for the track section 4 are reported to the automatic train protection unit 10.

As the FIGURE further shows, the rail vehicle 13 is equipped with a rail vehicle position determination device 15, with which the positions of train front and train end can be determined as accurately as possible. Data on the rail vehicle 13, such as length, number of axles and the positions of the axles in relation to the length of the rail vehicle 13, is saved in the rail vehicle position determination device 15.

If in the course of locating the rail vehicle 13 or determining the position of an axle of the rail vehicle 13 that corresponds to the information on the number of axles, the information on the number of axles Ae1 and Ae2 is transferred from the axle counter evaluators 6 and 8 to the train protection unit 10 and is forwarded from this via the message link 14 to the rail vehicle position determination device 15, then this information is processed by the rail vehicle position determination device 15.

If the rail vehicle 13 moves in the direction of the arrow 12, the first axle of the rail vehicle 13 affects the one sensor unit 3 at an assumed time instant T1. As a result the information on the number of axles Ae1 changes from "12" to the value "11". This also happens at time instant T1, which is why this information on the number of axles is provided with a time stamp according to the point T1, due to the time synchronization performed between rail vehicle position determination device 15 and the axle counter evaluator 6 in the exemplary embodiment shown. Practically simultaneously the further information on the number of axles Ae2 of the axle counter evaluator 8 changes from "0" to "1". This information is also given a corresponding time stamp.

The changed information on the number of axles Ae1 and Ae2 is transferred via the train protection unit 10 to the rail vehicle position determination device 15 and processed thereby.

The rail vehicle position determination device 15 has track topology data at its disposal, in particular position data for the sensor units 2, 3 and 5. The rail vehicle position determination device 15 can therefore conclude from the transferred information on the number of axles Ae1 and Ae2 that the first axle of the rail vehicle 13 is located exactly at the position of the sensor 3. Here the two items of information on the number of axles Ae1 and Ae2 serve to discover incorrect position determinations and if necessary discard the determination result; a further reference mark is not then produced.

The method according to the invention is in no way tied to the determination of the position of the first axle of a rail vehicle. Rather it can involve the last axle of a rail vehicle or any axles between the first and last axle.

The invention claimed is:

1. A method for locating a rail vehicle by reading positions of reference marks passed by the rail vehicle along a route of the rail vehicle and by evaluating additional distance information, the method comprising the following steps:

providing at least one track section on the route having axle counter sensor units bordering the at least one track section and an axle counter evaluator;

transferring information on a number of axles from the axle counter evaluator to a rail vehicle position determination device;

determining a position of an axle of the rail vehicle corresponding to the information on the number of axles in the rail vehicle position determination device using existing track topology data; and locating the rail vehicle using the determined position of the axle of the rail vehicle as a further reference mark.

2. The method according to claim 1, which further comprises carrying out the transferring step by transferring the information on the number of axles from the axle counter evaluator directly to the rail vehicle position determination device.

3. The method according to claim 2, which further comprises carrying out the transferring step by transferring the information on the number of axles over a radio link.

4. The method according to claim 1, which further comprises carrying out the transferring step by transferring the information on the number of axles from the axle counter evaluator through a train protection unit to the rail vehicle position determination device.

5. The method according to claim 4, which further comprises carrying out the transferring step by transferring the information on the number of axles from the axle counter evaluator over a communications link to the train protection unit and from the train protection unit over a message link to the rail vehicle position determination device.

6. The method according to claim 1, which further comprises performing a time synchronization between the axle counter evaluator and the rail vehicle position determination device.

7. The method according to claim 1, which further comprises:

transferring further information on the number of axles from a further axle counter evaluator assigned to a subsequent track section to the rail vehicle position determination device; and using the further information on the number of axles in the rail vehicle position determination device as redundant information on the number of axles in determining the position of the axle.

* * * * *